US007260230B2

(12) United States Patent
Feng

(10) Patent No.: US 7,260,230 B2
(45) Date of Patent: Aug. 21, 2007

(54) HIGH PERFORMANCE MICROPHONE AND MANUFACTURING METHOD THEREOF

(75) Inventor: Jen Nan Feng, Taoyuan County (TW)

(73) Assignee: Knowles Electronics, LLC., Itasca, IL (US)

( * ) Notice: Subject to any disclaimer, the term of this patent is extended or adjusted under 35 U.S.C. 154(b) by 645 days.

(21) Appl. No.: 10/801,371

(22) Filed: Mar. 16, 2004

(65) Prior Publication Data

US 2005/0089188 A1 Apr. 28, 2005

(30) Foreign Application Priority Data

Oct. 24, 2003 (TW) ..... 92218875 U

(51) Int. Cl.
*H04R 25/00* (2006.01)

(52) U.S. Cl. ..... 381/174; 381/191

(58) Field of Classification Search ..... 381/113, 381/174, 175, 176, 178, 190, 191, 355, 369, 381/398, 409–410; 29/25.41, 25.42, 594; 307/400; 367/140, 170, 181

See application file for complete search history.

(56) References Cited

U.S. PATENT DOCUMENTS 4,764,690 A * 8/1988 Murphy et al. ..... 307/400

7,184,563 B2 * 2/2007 Collins ..... 381/191

* cited by examiner

*Primary Examiner*—Huyen Le
(74) *Attorney, Agent, or Firm*—Marshall, Gerstein & Borun LLP

(57) ABSTRACT

A microphone (100) and method of manufacture thereof is disclosed. The microphone (100) includes a housing (108), a diaphragm assembly (120), a spacer (134), a backplate assembly (140), a body assembly (150), and a printed circuit board (164) disposed within the housing (100). The diaphragm assembly (120) and the backplate assembly (140) constitute a variable capacitor responsive to sound pressure level changes coupled through an acoustic port (118). The base capacitance is inversely proportional to the thickness of the spacer (134). The backplate assembly (140) is disk shaped with protrusions and coupled to the body assembly (150) such that an acoustic passage (172) is formed between an outer edge of the backplate assembly (140) and an inner periphery of the hollow body assembly (150). The body assembly (150) comprises conductive mount (158) for electrically coupling the backplate assembly (140) to a first surface (166) of a circuit board (164). A second surface (168) of the circuit board (164) is then held in contact with the connecting surface (114) of the housing (108) by mechanical fastening such as crimping, soldering, welding or adhesive bonding.

10 Claims, 4 Drawing Sheets

HIGH PERFORMANCE MICROPHONE AND MANUFACTURING METHOD THEREOF

TECHNICAL FIELD

This patent relates to microphones and more particularly to high performance electret microphones used in communication devices, audio devices or the like, and a method of manufacturing the same.

BACKGROUND

Mobile communication technology has progressed rapidly in recent years. Consumers are increasingly using mobile communication devices such as cellular phones, web-enabled cellular telephones, Personal Digital Assistants (PDAs), hand-held computers, laptops, tablets and other devices capable of communication over public or private communication networks. The expansion of cellular networks and technological advancements in mobile communications have resulted in more consumers using mobile communications devices. This increased demand for communication devices drives improvements in the manufacturing processes, power consumption, reception, fabrication, and miniaturization of audio components incorporated in the mobile communication devices. Competitive pressures among suppliers of mobile communication devices increase the demand for smaller, less expensive, and better performing miniature capacitor microphones.

Generally speaking, a variety of conventional electret condenser microphones ("ECMs") have been used for communication devices. A prior art ECM comprises a dust guard, a housing with an acoustic port, a vibratory diaphragm, a spacer, an insulating body, a backplate assembly, a conductive ring, and a printed circuit board ("PCB"). The diaphragm assembly and the backplate assembly constitute a variable capacitor portion responsive to sound pressure level changes coupled through the acoustic port corresponding to the thickness of the spacer.

As the size of the ECM is reduced, limited space is available to accommodate the insulating body and the conductive ring resulting in increased interference between the capacitor portion and the PCB. Apart from the pursuit of miniaturization, repetitive shocks and vibration may create a deleterious effect on acoustic performance of ECMs over time.

DETAILED DESCRIPTION

Figure 1:
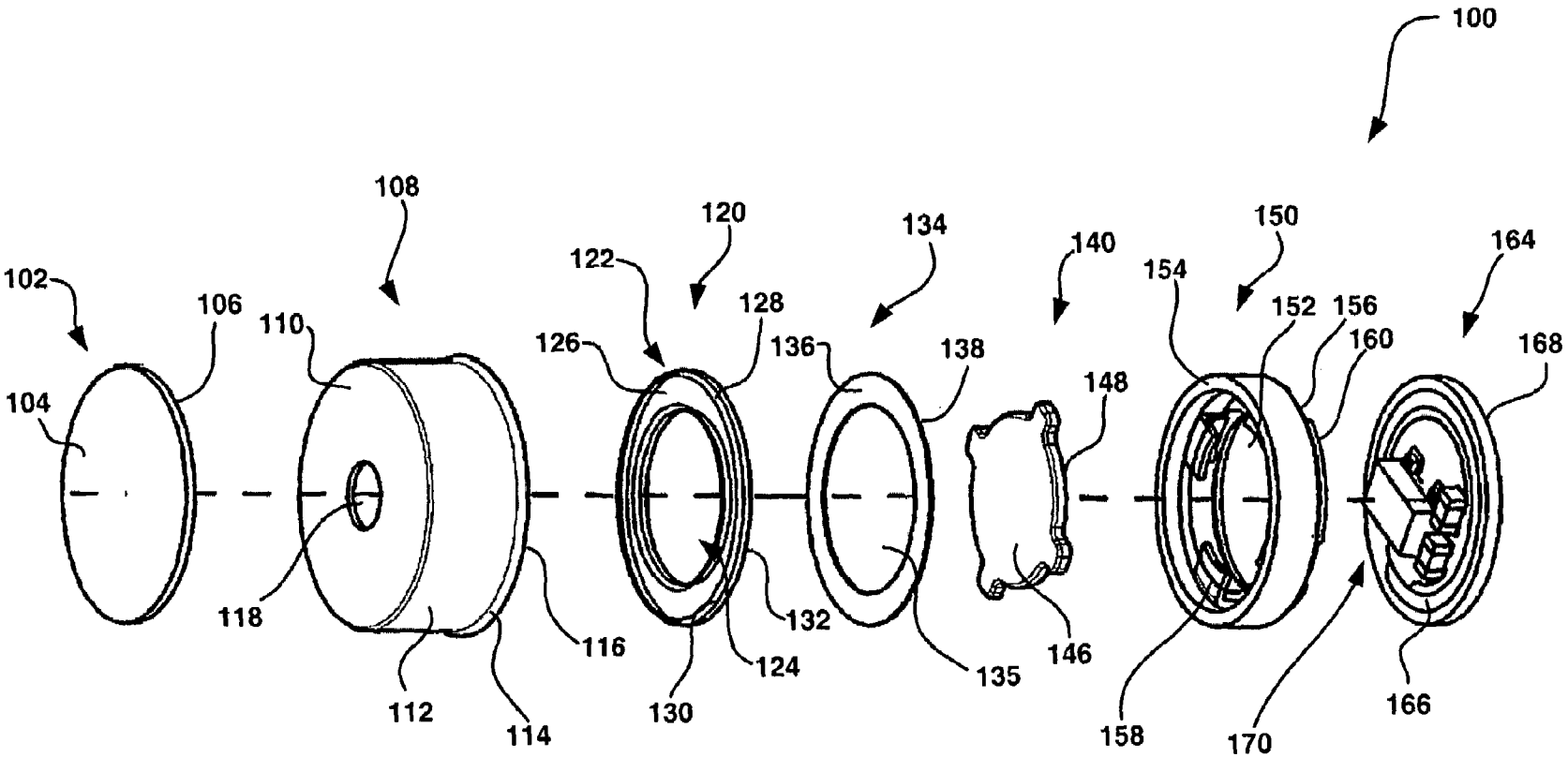
FIG. 1 is an exploded view of a capacitor microphone.

While this invention is susceptible to various modifications and alternative forms, certain embodiments are shown by way of example in the drawings and these embodiments will be described in detail herein. It should be understood, however, that this disclosure is not intended to limit the invention to the particular forms described, but to the contrary, the invention is intended to cover all modifications, alternatives, and equivalents falling within the spirit and scope of the invention defined by the appended claims.

FIG. 1 is an exploded view of a capacitor microphone 100 that can be used in virtually any type of communication device such as cellular phones, web-enabled cellular telephones, Personal Digital Assistants (PDAs), hand-held computers, other types of portable computing and Internet access appliances and devices, and the like, capable of communication over one or more public or private communication networks. The microphone 100 may include a cup-shaped housing 108 having an upper surface portion 110 and a side wall portion 112. In alternate embodiments, the housing 108 may take the form of various other shapes (e.g. rectangular, D-shaped, or trapezoid-shaped) and have a number of different sizes. The side wall portion 112 of the housing terminates at a connecting surface 114, defining an opening 116. The connecting surface 114 may be initially formed with an outward flare to enable placement of the other components in the housing 108.

When all the components are placed in final or closed position within the housing 108, the connecting surface 114 is bent or re-formed radially toward the center of the opening 116. This forming operation mechanically captures the back surface 168 of the PCB 164 by the connecting surface 114, locking the other components in position as well as electrically connecting the back surface 168 of the PCB 164. The housing 108 is shown to have at least one layer. However, the housing 108 may be fabricated from alternating layers of conductive materials and non-conductive materials or a non-conductive substrate may have a conductive coating applied on the inside allowing electrical connection of the diaphragm assembly 120 to the back surface 168 of the PCB 164. In one embodiment, the housing 108 is made of aluminum.

At least one aperture or acoustic port 118 is introduced on the upper surface 110 of the housing 108 to allow acoustic waves to be transmitted to the diaphragm assembly 120. The acoustic port 118 may be formed in any suitable manner such as drilling, punching or molding. The acoustic port 118 allows acoustic energy corresponding to sound pressure level changes to enter the housing 108.

A dust guard 102 in the form of a shape corresponding to the shape of the housing 108, but may take the form of various shapes not necessarily corresponding to the housing shape, and may have a number of different sizes. In one embodiment, the dust guard 102 is shown to have a circular shape corresponding to the circular shape of the housing 108. The dust guard may be made of cloth or felt having a first surface 104 and a second surface 106. The second surface 106 of the dust guard 102 is attached to the housing 108 by adhesive to cover the acoustic port 118. This helps to prevent debris from entering the microphone 100 damaging the electronic components 170 disposed within the housing 108. The dust guard 102 may also improve the frequency response, create delay and provide directional response.

The microphone 100 may further include a diaphragm assembly 120. The diaphragm assembly 120 includes a support ring 122 and a diaphragm 124 attached to the support ring 122. The diaphragm assembly 120 has a shape that generally corresponds to that of the housing 108 but may take the form of various shapes and have a number of different of sizes in different embodiments. The support ring 122 may be made of electrically conductive material such as stainless steel; however, any conductive material or material including a conductive coating, including brass or tin may be utilized. The support ring 122 has a first surface 126 and a second surface 128. The first surface 126 of the support ring 122 is held in contact with the upper surface 110 and the second surface 128 is held in contact with a spacer 134. The diaphragm 124 is made of an electrically conductive material capable of vibrating in response to acoustic waves. One such material is a polyethylene terephthalate film, commonly available under the trademark Mylar. The diaphragm 124 has a first surface 130 and a second surface 132. The first surface 130 of the diaphragm 124 is attached to the second surface 128 of the support ring 122, for example, by bonding with adhesive. However, it will be understood by those or ordinary skill in the art that any form of joining would suffice, including compression, or mechanical attachment at the edges, and the like. The second surface 132 of the diaphragm 124 is coated with a layer of conductive material such as chromium forming an electrically active portion, commonly referred to as the movable electrode is held in contact with a spacer 134.

The microphone 100 may further include a spacer 134 having a hollow section 135 and first and second surfaces, 136 and 138 respectively, for electrically isolating the diaphragm assembly 120 from other components within the housing 108. The spacer 134 is made of an electrically insulating material such as a 200 gauge Mylar plastic having a thickness spaced between the diaphragm assembly 120 and a backplate assembly 140. The spacer 134 enables deflection of the diaphragm 124 toward the backplate assembly 140. The spacer 134 may have various shapes not necessarily corresponding to the housing shape and may have a number of different sizes. In one embodiment, the spacer 134 is shown to have a circular in shape corresponding to the housing 108. The spacer 134 thickness and materials may vary depending on the requirements of the application. The spacer 134 is placed between the diaphragm assembly 120 and the backplate assembly 140 and held in place by mechanical pressure exerted by the connecting surface 114 after it is closed over the PCB 164. The first surface 136 of the spacer 134 is held in contact with the second surface 132 of the diaphragm 124. The second surface 138 of the spacer 134 is held in contact with the backplate assembly 140 and separates the diaphragm assembly 120 from the backplate assembly 140.

The microphone 100 may further include a backplate assembly 140. The backplate assembly 140 is shown to have at least one protrusion 142 and at least one relief section 144. However, the backplate assembly may include a plurality of protrusions 142*a-d* and a plurality of relief portions 144*a-d*, and such embodiment will be discussed in greater detail. The backplate assembly 140 is held between the second surface 138 of the spacer 134 and the body assembly 150 by the mechanical pressure of the connecting surface 114 as discussed above.

The microphone 100 also has a body assembly 150 having a hollow section 152 and upper and lower surfaces 154 and 156, respectively. The body assembly 150 is disposed within the housing 108. The body assembly 150 may be molded in various shapes and sizes to suit the needs of the application. In one embodiment, the body assembly 150 is cylindrical in shape and is made of an electrically insulating material such as a molded polyethylene plastic. When assembled, the first surface 154 of the body assembly 150 is held in contact with the second surface 138 of the spacer 134 by the mechanical pressure of the connecting surface, as described above. The second surface 156 of the body assembly 150 is formed with a positioning projection member 160. The positioning projection member 160 is designed to receive the PCB 164 to mechanically isolate, but electrically connect, the backplate assembly 140 to the PCB 164. As such, the spacing between the backplate assembly 140 and the diaphragm assembly 120 are not affected by deformations in the housing 108. In one example, the positioning projection member 160 is made of an electrically conducting material such as stainless steel; however, any conductive material or material including a conductive coating may be utilized.

The microphone 100 still further includes a printed circuit board (PCB) 164 disposed in the housing 108. The PCB 164 may be coaxially aligned with the housing 108. The PCB 164 has a front surface 166 and a back surface 168. The PCB 164 may be formed in various shapes and sizes corresponding to the housing or otherwise according to specific applications. The front surface 166 of the PCB 164 may have printed wiring traces and a plurality of electronic components 170, such as a junction field effect transistor (JFET) and at least one capacitor for converting the changes in electrical capacitance generated by the diaphragm assembly 120 and the backplate assembly 140 into electric impedance. The front surface 166 of the PCB 164 is held in contact with the positioning projection member 160 and electrically connected via the conductive mount 158 to the backplate assembly 140. The back surface 168 has printed wiring traces and is electrically coupled to the housing 108 via the connecting surface 114. The PCB 164 may be attached to the conductive mount 158 via a soldering process; however, any form of electrical connection would suffice.

The body assembly 150 is then press-fit into the housing 108 in contact with the spacer 134. The press-fit of the body assembly 150 restrains the underlying components to reduce shifting and damage that may occur during manufacturing. Further, the body assembly 150 makes it possible that the backplate assembly 140 and the diaphragm assembly 120 are electrically connected with the PCB 170 with no deformation of the positioning projection member 160.

Figure 2:
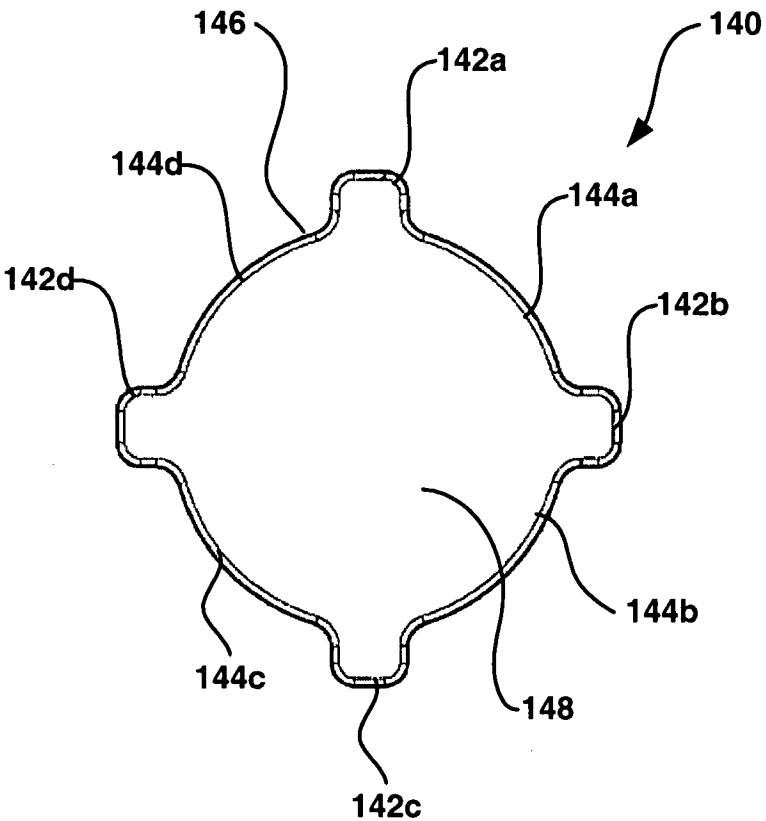
FIG. 2 is a top view of a backplate assembly.

Referring to FIG. 2, one embodiment of the backplate assembly 140 is shown. The backplate assembly 140 is punched into a disk shape having at least one protrusion 142 and at least one relief section 144. In the embodiment shown, the backplate assembly 140 includes a plurality of protrusions 142*a-d* and a plurality of relief portions 144*a-d*. The backplate assembly 140 is made of an electrically conducting material such as stainless steel; however, any conductive material or material including a conductive coating may be utilized. The backplate assembly 140 has a first surface 146 and a second surface 148. The first surface 146 of the backplate assembly 140 may be coated or covered with a polarized dielectric film or electret material such as Teflon. In operation, the backplate forms a fixed electrode and may be electrostatically charged to a predetermined surface charge, for example, 360V. The second surface 148 is made of an electrically conducting material such as a stainless steel. Formed in this manner, the backplate assembly 140 has the advantage of increased surface area under the center, or most mobile areas of the diaphragm 124, thereby increasing the electro-acoustic performance of the microphone 100. A device built in accordance with the inventive concepts disclosed herein has the advantage of reduced overall size while maintaining good electro-acoustic performance for sensitivity, noise, stability, compactness, robustness, and insensitivity to electromagnetic interference ("EMI") and other external and environmental conditions, including shock and debris.

Figure 3:
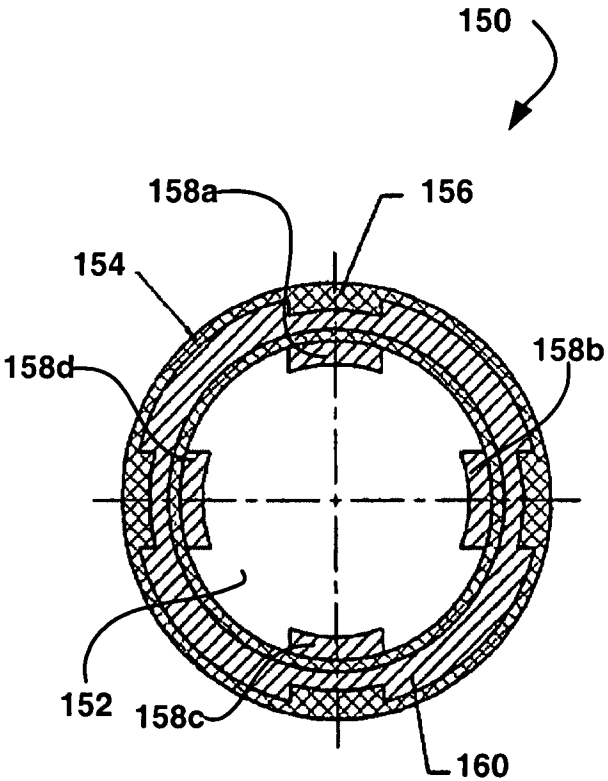
FIG. 3 is a top view of a body assembly.

Referring now to FIG. 3, the body assembly 150 is pressed or molded, in one embodiment, into a cylindrical shape, having the hollow section 152. The body assembly 150 is made of an electrically insulating material such as molded polyethylene plastic having an upper surface 154 and a lower surface 156. The positioning projection member 160 is made of an electrically conducting material such as stainless steel and may molded or press-fit into the lower surface 156 of the body assembly 150. The upper ends 158*a-d* may be punched out and attached to or molded into the inner peripheral portion of the body assembly 150. The conductive mount 158 and the positioning projection member 160 may be formed from the same stock and molded or press-fit to the body assembly 150 as one unit. Using a body assembly 150 provides the advantage of reduced overall size of the device while maintaining good electro-acoustic performance. In another embodiment, the backplate assembly 140 may be round without protrusions 142*a-d*. To create the necessary acoustic passages 172 the body assembly may be formed to provide a relief around at least a portion of the outer edge of the backplate assembly 140.

Figure 5:
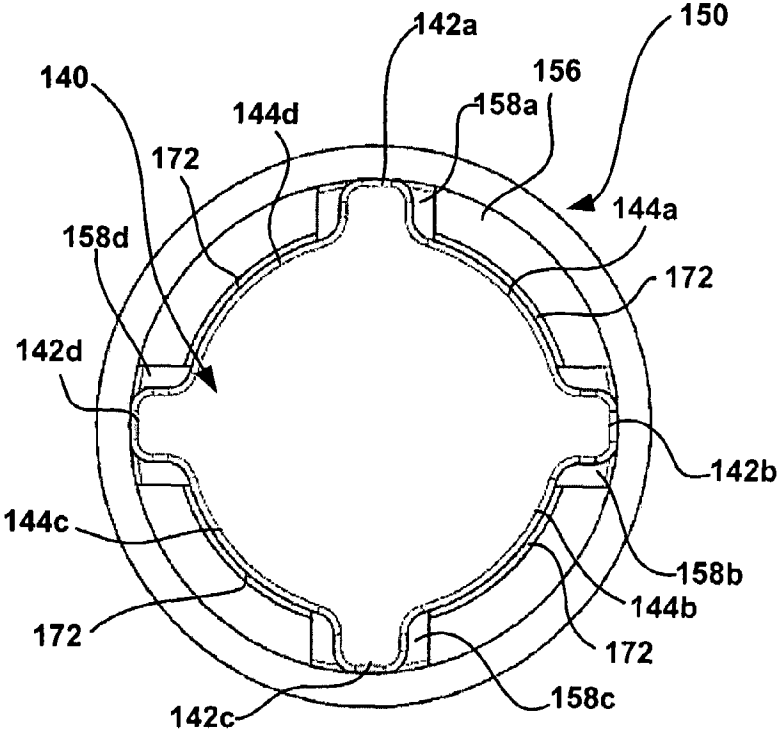
FIG. 5 is a top view of FIG. 4 of the configuration of the backplate and the body assembly.
Figure 4:
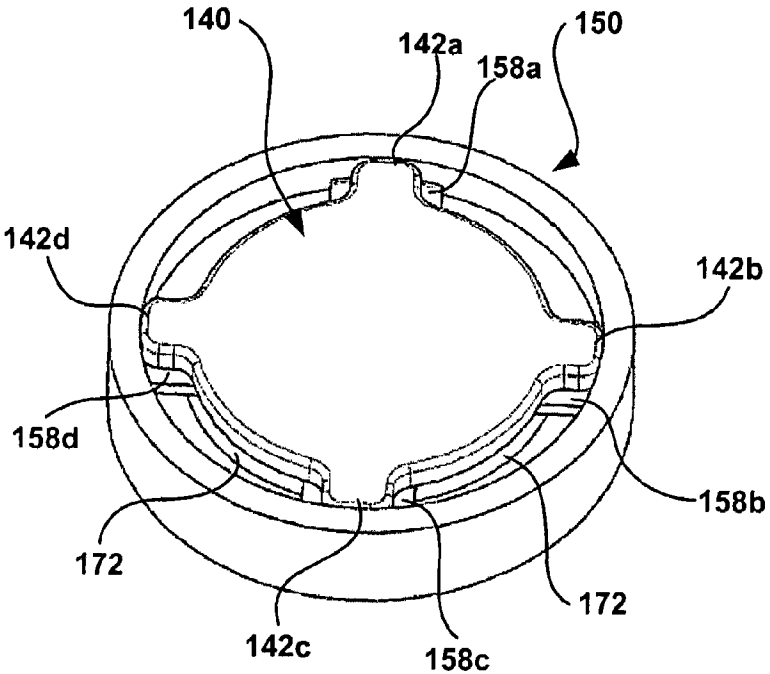
FIG. 4 is a perspective view showing the configuration of the backplate and the body assembly.

Referring to FIGS. 4 and 5, the body assembly 150 and the backplate assembly 140 are discussed and described. The inner peripheral portion of the body assembly 150 is formed with a conductive mount 158 with a plurality of upper ends 158*a*, 158*b*, 158*c*, 158*d*. In one example, the conductive mount 158 is made of an electrically conducting material such as stainless steel; however, any conductive material or material including a conductive coating may be utilized. The conductive mount 158 is electrically connected to the positioning projection member 160 by welding or soldering. The conductive mount 158 and the positioning projection member 160 may alternatively be formed from the same piece of stock. The conductive mount 158 is disposed to receive the second surface 148 of the backplate assembly 140. Each protrusion 142*a-d* on the backplate assembly 140 is attached to a corresponding mounting point formed by the upper ends 158*a-d* of the conductive mount 158. The attachment may be made by bonding with adhesive. Alternative forms of joining may include compression, mechanical attachment, and the like. The backplate assembly 140 may be joined to the body assembly 150 prior to mounting in the housing 108, or the backplate assembly 140 may be joined to the body assembly 150 during final assembly of the microphone 100.

The backplate assembly 140 is press-fit into the body assembly 150 and attached to the conductive mount 158 by bonding with adhesive disposed within the inner peripheral portion of the body assembly 150. The alternating protrusions define a plurality of acoustic passages 172. The acoustic passages 172 are located away from the high mobility center of the diaphragm to the outer edge of the backplate at the relief portions 144*a-d*, allowing free flow of air in the space between the diaphragm 124 and the backplate assembly 140 to the back volume where the PCB 160 is situated without sacrificing performance.

Figure 6:
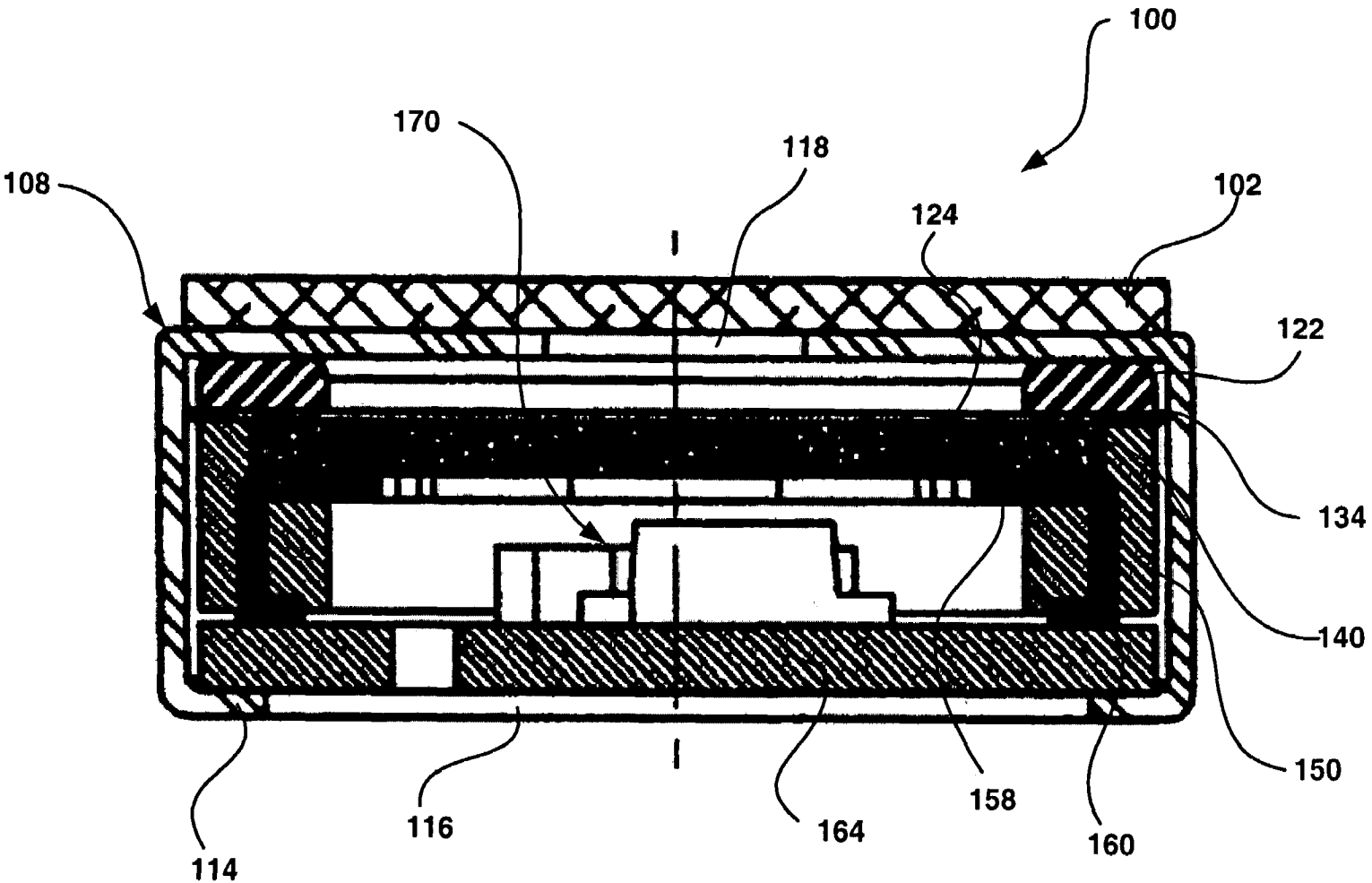
FIG. 6 is a cross-sectional view of a capacitor microphone.

FIG. 6 is a cross-sectional view that will be referred to in conjunction with a description of an embodiment of a method of assembling the microphone 100. First, the diaphragm assembly 120 is inserted in the housing 108, opposed to the acoustic port 118. The spacer 134 is then inserted in the housing 108 with the first surface 136 of the spacer 134 facing the second surface 132 of the diaphragm assembly 120. Next, the backplate assembly 140 is inserted into the body assembly 150. The first surface 146 of the backplate assembly 140 is oriented to be facing the second surface 138 of the spacer 134 when inserted into the housing 108. The plurality of protrusions 142*a-d* are aligned and adhered to the plurality of upper ends 158*a-d* of the conductive mount 158. The body assembly 150 is then inserted into the housing 108. The backplate assembly 140, the spacer 134, and the diaphragm assembly 120 are restrained from shifting their position due to vibrations occurring during manufacturing by the friction fit of the body assembly 150. The second surface 156 of the body assembly 150 is formed with a positioning projection member 160 disposed at a position corresponding to the PCB 164. The PCB 164 is preassembled with a plurality of electronic components 170. After the diaphragm assembly 120, the spacer 134, the backplate assembly 140, and the body assembly 150 are completely inserted into the housing 108, the back surface 168 of the PCB 164 is captured by the connecting surface 114 of the housing 108 by mechanical fastening, crimping, welding or adhesive bonding, for instance. In this position, the diaphragm assembly 140 and the backplate assembly 140 are electrically connected with the PCB 164.

All references, including publications, patent applications, and patents, cited herein are hereby incorporated by reference to the same extend as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Several embodiments of this invention are described herein, including the best mode known to the inventors for carrying out the invention. It should be understood that the illustrated embodiments are exemplary only, and should not be taken as limiting the scope of the invention.

What is claimed is:

1. An electret microphone comprising:

a housing having an acoustic port formed in a wall thereof;

a diaphragm assembly being electrically conductive and electrically coupled to the housing, the diaphragm assembly positioned adjacent to the wall;

an insulating spacer placed adjacent to the diaphragm on a side of the diaphragm opposite the acoustic port;

a backplate assembly, the backplate assembly with a protrusion radially extending from an outer circumference, the backplate in contact with the insulating spacer;

a body assembly, the body assembly molded of plastic, having a first end and a second end, the body assembly adapted for insertion into the housing and being hollow with an inner periphery adapted to receive the backplate assembly, the body assembly further comprising:

a conductive mount disposed in the body assembly, the conductive mount having a first end and a second end, the conductive mount electrically insulated from the housing by an outer circumference of the body assembly, the first end of the conductive mount disposed into the hollow portion of the body assembly for electrically coupling with the backplate assembly, the second end of the conductive mount extending to the second end of the body assembly; and a printed circuit board adapted for coupling to the second end of the body assembly, the printed circuit board having a first surface and a second surface, wherein the first surface is electrically coupled to the second end of the conductive mount and the second surface is coupled to the housing, whereby an acoustic passage is formed at the sides of the protrusion between an inner circumference of the housing and an outer circumference of the backplate assembly, the acoustic passage allowing air flow created by movement of the diaphragm responsive to acoustic energy coupled into the acoustic port.

2. The electret microphone of claim 1 wherein the housing comprises a connecting surface having a first position and a second position, wherein the connecting surface in the second position mechanically retains the printed circuit board.

3. The electret microphone of claim 1 wherein the housing comprises a connecting surface having a first position and a second position, wherein the connecting surface in the second position electrically contacts the second surface of the circuit board.

4. The electret microphone of claim 1 having the first end of the conductive mount disposed relative the first end of the body assembly a distance equivalent to the thickness of the backplate assembly, whereby a side of the backplate facing the diaphragm is level with the first end of the body assembly.

5. The electret microphone of claim 1 wherein the first end of the conductive mount is bonded to the backplate assembly at the protrusion.

6. The electret microphone of claim 1 wherein diaphragm assembly further comprises a support ring.

7. The electret microphone of claim 1 further comprising a dust guard disposed on a surface of the housing, the dust guard covering the acoustic port.

8. The electret microphone of claim 1 wherein the second end of the conductive mount further comprises a positioning projection member.

9. The electret microphone of claim 1 wherein the backplate assembly comprises a conductive backplate and a dielectric covering one surface of the conductive backplate.

10. The electret microphone of claim 1 wherein the backplate conductive backplate assembly comprising a is free of holes.

* * * * *

UNITED STATES PATENT AND TRADEMARK OFFICE

CERTIFICATE OF CORRECTION

PATENT NO. : 7,260,230 B2
APPLICATION NO. : 10/801371
DATED : August 21, 2007
INVENTOR(S) : Feng J. Nan It is certified that error appears in the above-identified patent and that said Letters Patent is hereby corrected as shown below:

On the Title Page:

At item (73), "LLC." should be -- LLC --.

At Column 8, lines 21-22, "the backplate conductive backplate assembly comprising a is" should be -- the backplate assembly comprising a conductive backplate is --.

Signed and Sealed this

Fourth Day of March, 2008

JON W. DUDAS
*Director of the United States Patent and Trademark Office*